US006902304B2

(12) United States Patent
Yang

(10) Patent No.: US 6,902,304 B2
(45) Date of Patent: Jun. 7, 2005

(54) STOPPER

(76) Inventor: Jing-Sheng Yang, 4F., No. 26, Lane 358, Yung-An St., Tainan City 700 (TW)

( * ) Notice: Subject to any disclaimer, the term of this patent is extended or adjusted under 35 U.S.C. 154(b) by 0 days.

(21) Appl. No.: 10/429,794

(22) Filed: May 6, 2003

(65) Prior Publication Data

US 2004/0223332 A1 Nov. 11, 2004

(51) Int. Cl.[7] ..... B60Q 3/04

(52) U.S. Cl. ..... 362/362; 362/806; 362/101; 362/154; 362/155

(58) Field of Search ..... 362/101, 362, 362/154, 155, 806; 215/355, 400

(56) References Cited

U.S. PATENT DOCUMENTS 6,712,483 B2 * 3/2004 Lin et al. ..... 362/101

* cited by examiner

*Primary Examiner*—Stephen Husar
*Assistant Examiner*—Anabel Ton
(74) *Attorney, Agent, or Firm*—Leong C. Lei

(57) ABSTRACT

The present invention discloses a stopper composed of a hyaline port, a coupling, a light emitting means, a buffer ring, an embedding port and an insertion. The light emitting means is positioned in a top hollow of the coupling and then embedded into a cave of the hyaline port. An insulated ring surrounding batteries is housed in the lower hollow of the coupling. The coupling can be eventually screwed in the embedding port deposited in the insertion. By screwing the coupling more tightly, a lead beneath the light emitting means can contact with the battery to form electrical conduction, and therefore the hyaline port exhibits fancy or identification effect.

1 Claim, 4 Drawing Sheets

STOPPER

BACKGROUND OF THE INVENTION

1. Field of the Invention

The present invention relates to a stopper, and particularly to a stopper suitable for inserting a bottle and capable of exhibiting identification and/or fancy light effect.

2. Description of Prior Arts

Conventionally, in order to preserve bottled alcoholic drinks, corks are provided as stoppers to be inserted in the bottles. However, most bottles and corks usually have similar colors and shapes, which always takes users much time to recognize. Additionally, the corks are very easily damaged after pulled and inserted two or three times.

Therefore, it is desirable to provide an improved stopper to mitigate and/or obviate the aforementioned problems.

SUMMARY OF THE INVENTION

An object of the present invention is to provide a stopper, which is suitable for inserting in a bottle and therefore facilitates recognizing drink contained therein.

Another object of the present invention is to provide a stopper, which is more durable and diversified than the conventional cork.

In order to achieved the above objects, the stopper of the present invention primarily includes a hyaline port, a coupling, a light emitting means, a buffer ring, an embedding port and an insertion. The hyaline port can be made of any proper material and defines a cave on a bottom thereof. The hyaline port is usually a transparent or translucent object in arbitrary shape. The coupling defines a receiving port on top thereof and a step-like hollow in center thereof, and has screw threads surrounding a lower and thinner part thereof. An insulated ring contacts to interior and lower surface of the hollow. The light emitting means is housed in the hollow in the receiving port of the coupling and comprises a circuit board, an illuminant deposited on the circuit board, a dividing sheet deposited on a bottom of the circuit board, and two leads respectively formed on an edge of the circuit board and beneath the dividing sheet. The circuit board can be designed to turn on/off the illuminant or vary color or brightness thereof, optionally. The buffer ring surrounds where the receiving port and the screw threads of the coupling connect to each other. The embedding port defines a cave in a center thereof, and the cave has interior screw threads corresponding to the screw threads of the coupling. The insertion is a conoid with check rings and defines a top cave for receiving the embedding port. The stopper can be assembled by positioning the light emitting means in the hollow within the receiving port of the coupling, embedding the coupling in the cave of the hyaline port, housing the insulated ring and a battery in the hollow of the coupling, and screwing the coupling to the embedding port deposited in the insertion. Accordingly, electrical conduction can be formed and the illuminant can be lit by contacting the lead beneath the circuit board to the battery, when the coupling is screwed more tightly and compressing the buffer ring.

Other objects, advantages, and novel features of the invention will become more apparent from the following detailed description when taken in conjunction with the accompanying drawings.

BRIEF DESCRIPTION OF THE INVENTION

Figure 4:
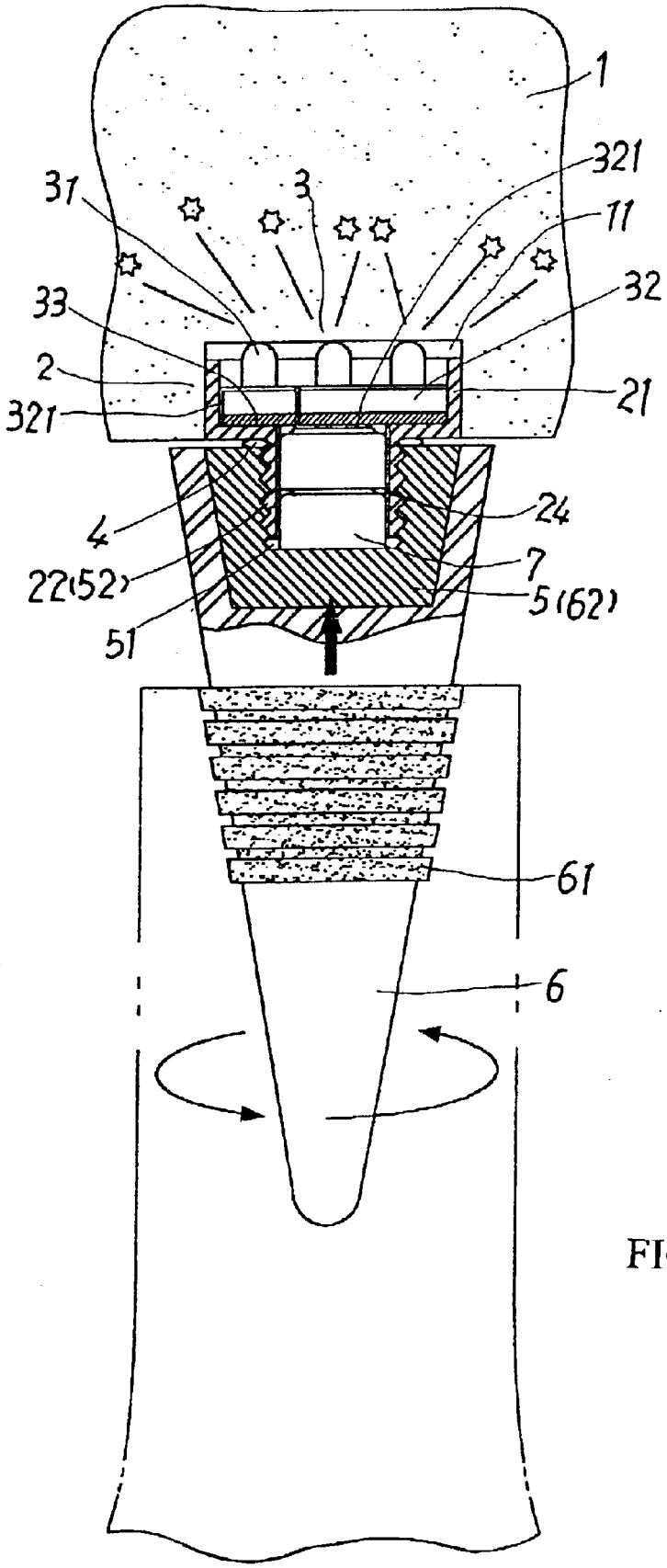

FIG. 4 further shows the state of the stopper in use.

DETAILED DESCRIPTION OF THE PREFERRED EMBODIMENTS

Figure 1:
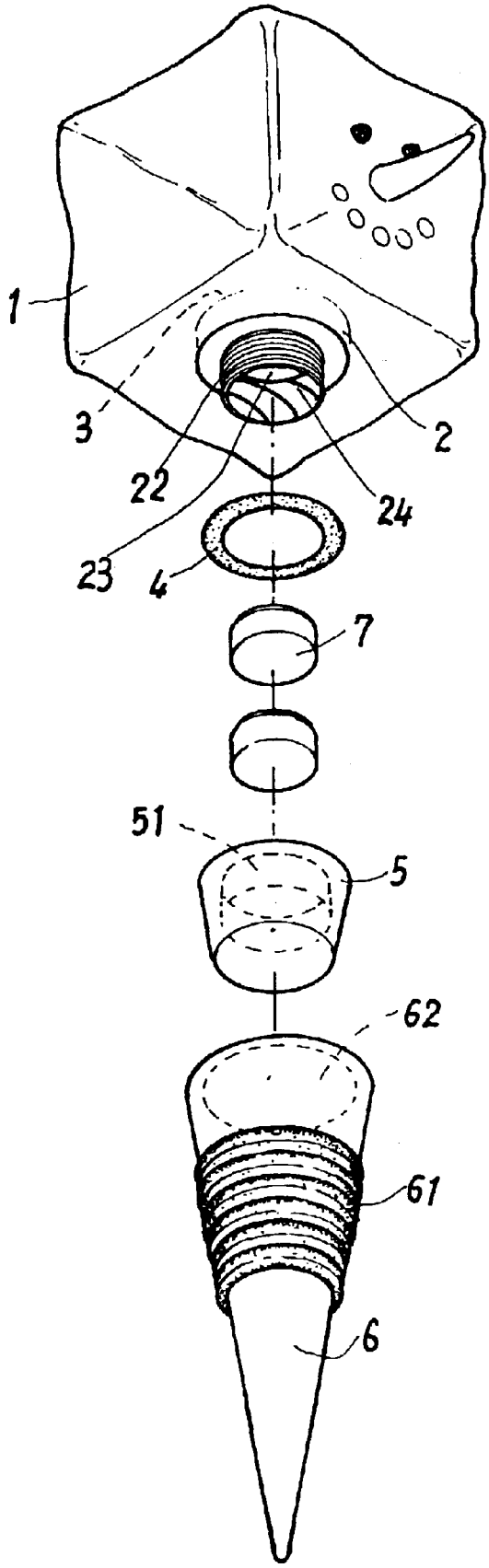
FIGS. 1 and 2 show components of the stopper in accordance with the present invention and relationship therebetween.
Figure 2:
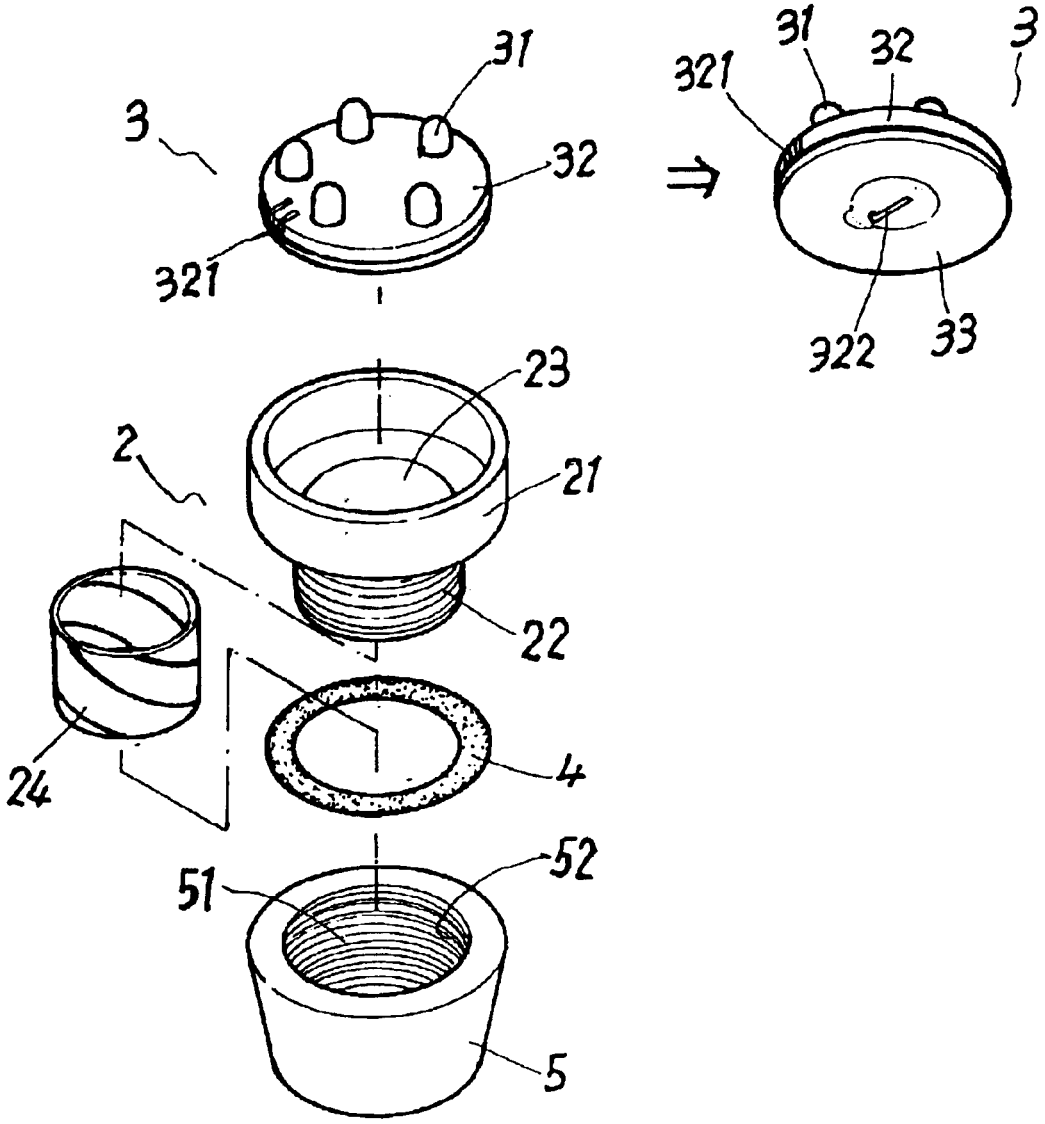

FIGS. 1 and 2 show components of a stopper in accordance with the present invention and relationship therebetween. The components include a hyaline head 1, a coupling 2, a light emitting means 3, a buffer ring 45, an embedding member 5 and an insertion 6.

The hyaline head can be made of any proper material, transparent or translucent, for example, acrylic fibers, glass, crystal, etc. The shape of the hyaline head is not limited, and can be designed according to personal tastes or classification of the drinks.

The coupling 2 is electrically conductive and looks like a hollow bolt, i.e., the upper side has a larger diameter than the lower side. Accordingly, the coupling 2 defines a receiving port 21 on top thereof and a step-like hollow 23 in center thereof. As shown in FIGS 1–4, the light emitting means 3 can be received in the receiving port 21, and then embedded in a cave 11 formed in the bottom of the hyaline head 1. The coupling 2 has screw threads 22 on the exterior surface of the lower portion. An insulated ring 24 contacts to the interior surface of the lower portion of the coupling 2. The buffer ring 4 is usually resilient and surrounds the coupling 2 where the lower side is adjacent to the upper side, i.e., where the screw threads 22 of the coupling 2 nears the receiving port 21.

The light emitting means 3 includes a circuit board 32, several illuminants 31 deposited on the circuit board 32, a dividing sheet 33 deposited on a bottom of the circuit board 32, and two leads 321 and 322 respectively formed on an edge of the circuit board 32 and beneath the dividing sheet 33 by penetrating the dividing sheet 33.

The embedding member 5 is electrically conductive and defines a recess 51 in a center thereof. The recess 51 has interior screw threads 52 corresponding to the screw threads 22 of the coupling 2. Therefore, the coupling 2 can be screwed to the embedding member 5.

The insertion 6 is a conoid with check rings 61 and defines a top cavity 62 for receiving the embedding member 5.

Figure 3:
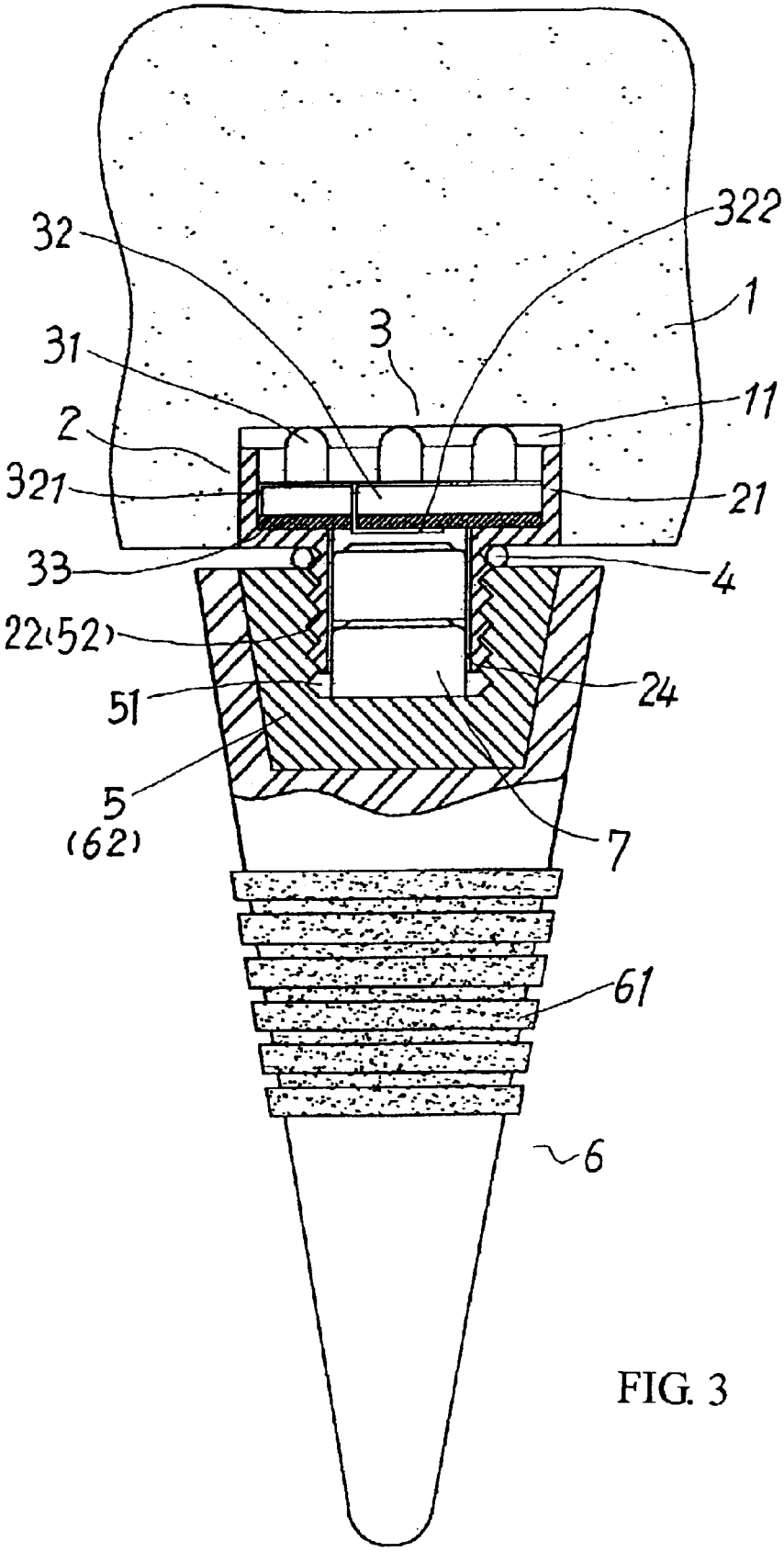
FIG. 3 shows the stopper of the present invention assembled well.

Referring to FIG 3, the stopper can be assembled by first positioning the light emitting means 3 in the upper hollow 23 within the receiving port 21, which is then embedded in the cave 11 of the hyaline head 1. The insulated ring 4 and two batteries 7 are then housed in the lower hollow 23 of the coupling 2. The insulated ring 24 is provided between the batteries and the interior wall of the coupling to avoid electrical conduction therebetween. At last, the coupling 2 is screwed to the embedding member 5 deposited in the insertion 6.

In the above embodiment, the embedding member 5 and the insertion 6 of the present invention are manufactured separately. They also can be manufactured integrally, optionally. Hence, the cave 62 of the insertion 6 is just the cave 51 of the embedding port 5, and the interior screw 52 can be formed on interior surface of the cave 62.

FIG 4 further shows the state of the stopper in use, in which the buffer ring 4 is compressed by screwing the coupling 2 more tightly, and therefore the lead 321 on the circuit board 32, the coupling 2, the embedding member 5, the batteries 7 and the lead 322 form an electrically conductive loop to light the illuminants 31. The circuit board 32 of the present invention can be designed to turn on/off, vary color or brightness of the illuminants. The assembled stopper can be inserted in a bottle by closely contacting the check rings 61 of the insertion 6 with the opening of the bottle.

On the other hand, by slightly loosing the coupling 2 from the embedding member 5, the lead 322 is moved apart from the battery, and the illuminants can be turn turned off as shown in FIG. 3.

According to the above embodiments, the stopper of the present invention exhibits advantages as follows:

a) the stopper can be easily assembled by simply screwing and inserting;

b) the stopper can show fancy light effect;

c) the drinks can be easily recognized according to the diversified stoppers; and d) the insulated ring can effectively separate the battery from the coupling so as to avoid unexpected electrical energy consumption.

Although the present invention has been explained in relation to its preferred embodiment, it is to be understood that many other possible modifications and variations can be made without departing from the spirit and scope of the invention as hereinafter claimed.

What is claimed is:

1. A stopper comprising:

a hyaline head having a bottom formed with a cave;

an electrically conductive tubular coupling fitted in said cave and having a top formed with a receiving port, said coupling having a lower portion formed with external threads;

an insulated ring fitted in said tubular coupling;

a buffer ring fitted over said lower portion;

a plurality of batteries fitted in said insulated ring;

light emitting means including a circuit board, a plurality of illuminants deposited on said circuit board, a dividing sheet deposited on a bottom of said circuit board, a first lead in contact with an inner side of said electrically conductive tubular coupling, and a second lead extending through said dividing sheet;

an embedding member having a recess with an open top, said recess being threaded to engage with external threads of said lower portion of said electrically conductive tubular coupling; and a conical insertion having a cavity configured to receive said embedding member and having a plurality of check rings;

whereby when said conical insertion is inserted into a bottle and said hyaline head is turned to compress said buffer ring, said batteries will be in contact with said second lead thereby forming a closed circuit and therefore causing said illuminants to give light, and when said hyaline head is turned to release said buffer ring, said batteries will not be in contact with said second lead thereby turning off said illuminants.

* * * * *